US005426406A

United States Patent [19]

Morris et al.

[11] Patent Number: 5,426,406

[45] Date of Patent: Jun. 20, 1995

[54] INDUCTION MOTOR PROTECTIVE CIRCUIT BREAKER UNIT

[75] Inventors: Robert A. Morris, Burlington; David D. MacDonald, Unionville, both of Conn.

[73] Assignee: General Electric Company, New York, N.Y.

[21] Appl. No.: 262,394

[22] Filed: Jun. 15, 1994

Related U.S. Application Data

[63] Continuation of Ser. No. 140,928, Oct. 10, 1993, abandoned, which is a continuation of Ser. No. 716,444, Jun. 17, 1991, abandoned.

[51] Int. Cl.[6] ..... H01H 9/02

[52] U.S. Cl. ..... 335/202; 335/8; 337/297

[58] Field of Search ..... 335/8–9, 335/67–76, 202; 337/297

[56] References Cited

U.S. PATENT DOCUMENTS

| | | | |
|---|---|---|---|
| 3,638,157 | 1/1972 | Kruzic | 335/9 |
| 4,649,455 | 3/1987 | Scott . | |
| 4,754,247 | 6/1988 | Raymont . | |
| 4,890,184 | 12/1989 | Russell . | |
| 4,913,503 | 4/1990 | Castonguay et al. | 335/172 |
| 4,967,304 | 10/1990 | Dougherty . | |
| 5,153,544 | 10/1992 | Castonguay . | |

FOREIGN PATENT DOCUMENTS

| | | | |
|---|---|---|---|
| 7716828 | 6/1977 | France | 337/297 |

*Primary Examiner*—Lincoln Donovan
*Attorney, Agent, or Firm*—Richard A. Menelly

[57] ABSTRACT

A molded case circuit breaker unit having an accessory compartment within the circuit breaker cover, contains a field-replaceable fuse within the compartment for protecting an electric motor without tripping upon motor current reversal. Upon the occurrence of a short circuit within the protected circuit, the fuse operates to isolate the protected equipment and is conveniently replaced without disassembling the circuit breaker components.

4 Claims, 5 Drawing Sheets

INDUCTION MOTOR PROTECTIVE CIRCUIT BREAKER UNIT

This application is a continuation of application Ser. No. 08/140,928 filed 10 Oct. 1993 which is a continuation of application Ser. No. 07/716,444, filed Jun. 17, 1991 both now abandoned.

BACKGROUND OF THE INVENTION

When electric motors are used in a machine tool cutting operation, large in-rush currents are temporarily generated when the electric motors are reversed to change the direction of the cutting tools. Heretofore, fuses were used in series with thermal overload relays in the motor control equipment to protect the motor and associated equipment. When the fuses were subjected to thermal aging by repeated subjection to high transient reversing currents the fuses had to be frequently replaced. With the advent of the so-called "energy efficient" motors that operated at lower normal operating currents and higher currents during current reversal, the ratings of the fuses were selected to sustain the higher transient reversing currents and resist thermal aging. The higher-rated fuses however do not coordinate as well with the thermal overload relays used within the motor control units and find limited application outside the tool-making industry.

U.S. Pat. No. 5,153,544 describes an industrial-rated circuit breaker having an electronic trip unit that is adjustable over a wide range of long and short time over-current conditions. The circuit breaker also includes an accessory cover wherein components can be installed within the field without disturbing the circuit breaker operating components.

U.S. Pat. No. 4,967,304 describes a digital circuit interrupter with electric motor trip parameters that includes control algorithms tailored for motor protection applications. It would be economically advantageous to have a combined circuit breaker-fuse arrangement whereby the fuse does not need frequent replacement when used within machine tool cutting operations and wherein the circuit breaker magnetic trip function can be adjusted to provide coordination between the short circuit protection provided by the fuse and the long time over-current protection provided by the thermal overload relay.

One purpose of the invention is to provide a circuit breaker-fuse arrangement wherein the short circuit protection provided by a fuse can be coordinated with the long time over-current protection provided by a thermal overload relay

SUMMARY OF THE INVENTION

The invention comprises an inductive motor protective molded case circuit breaker that includes a fuse for coordinating circuit protection with a thermal overload relay when a high efficiency electric motor is used within the tool-making environment, The electronic trip unit within the circuit breaker is adjusted for short time over-current protection while the fuse is selected to protect against short circuits, The fuse can optionally be installed within the circuit breaker accessory enclosure or in a separate compartment attached to the circuit breaker housing,

DESCRIPTION OF THE PREFERRED EMBODIMENT

Figure 1:
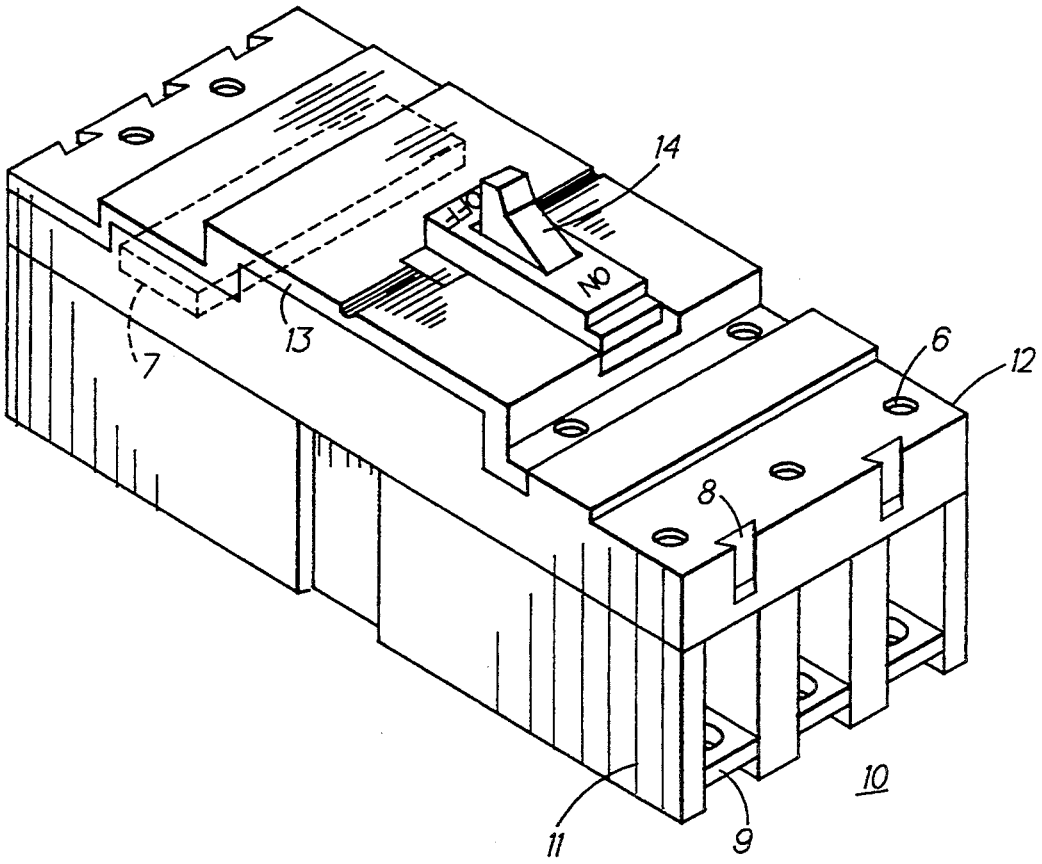
FIG. 1 is a top perspective view of the inductive motor protective molded case circuit breaker containing an electric fuse in accordance with the invention.

The motor protective circuit breaker 10 is shown in FIG. 1 and consists of a molded plastic case 11 to which a molded plastic cover 12 is attached. An accessory cover 13 as described in U.S. Pat. No. 4,754,247 is arranged on the top of the cover on opposite sides of the operating handle 14. The electronic trip unit 7 contained within the circuit breaker case is described within U.S. Pat. No. 4,649,455. The load terminals 9 at the load end of the circuit breaker are arranged for connection with the protected electrical equipment and are electrically accessed by means of the openings 6 arranged within the cover. The dovetail slots 8 arranged within the end of the cover serve to attach the fuse module 33 shown in FIG. 4.

Figure 2:
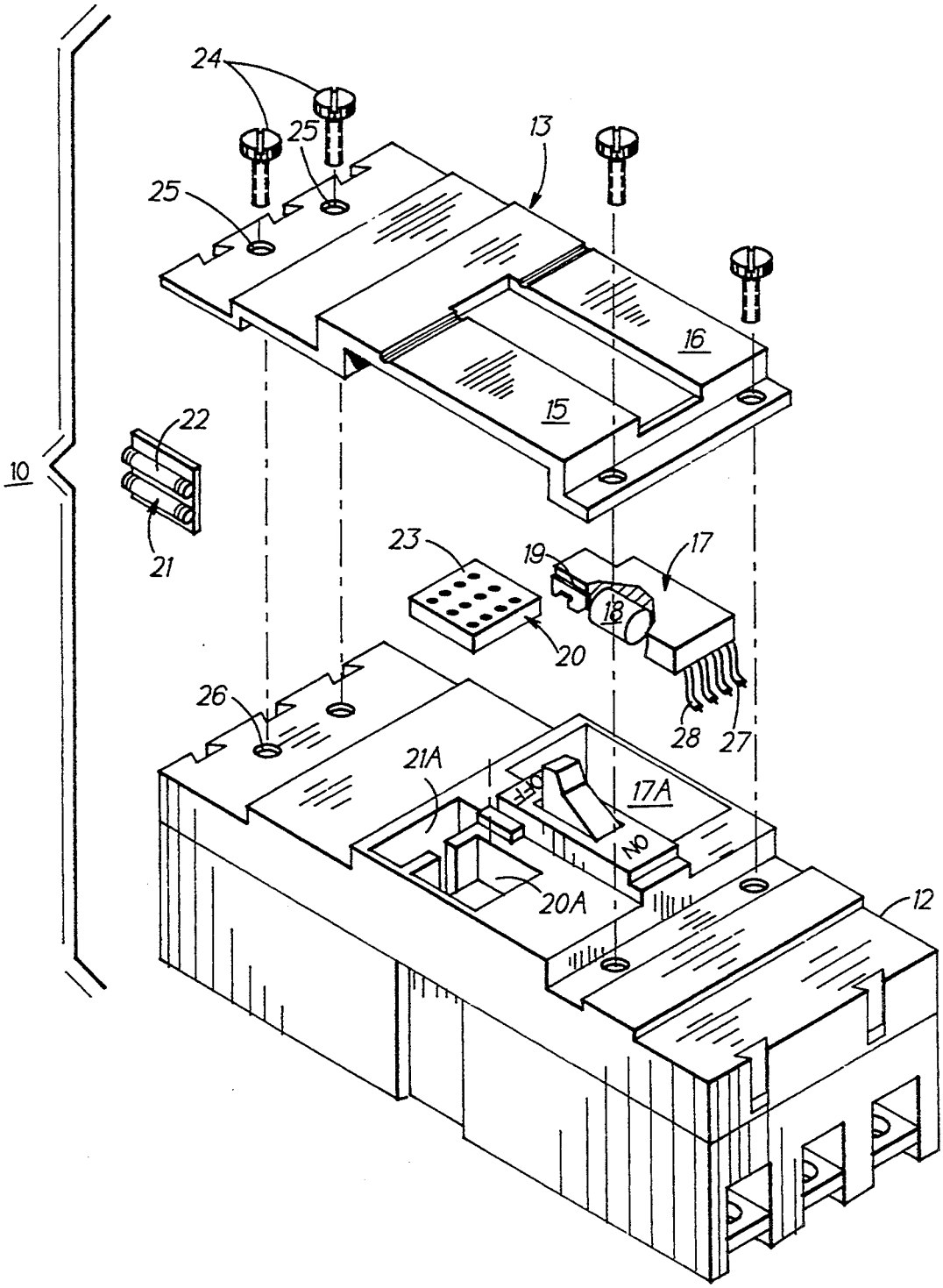
FIG. 2 is a top perspective view of the circuit breaker of FIG. 1 prior to assembling the electric fuse.
Figure 3:
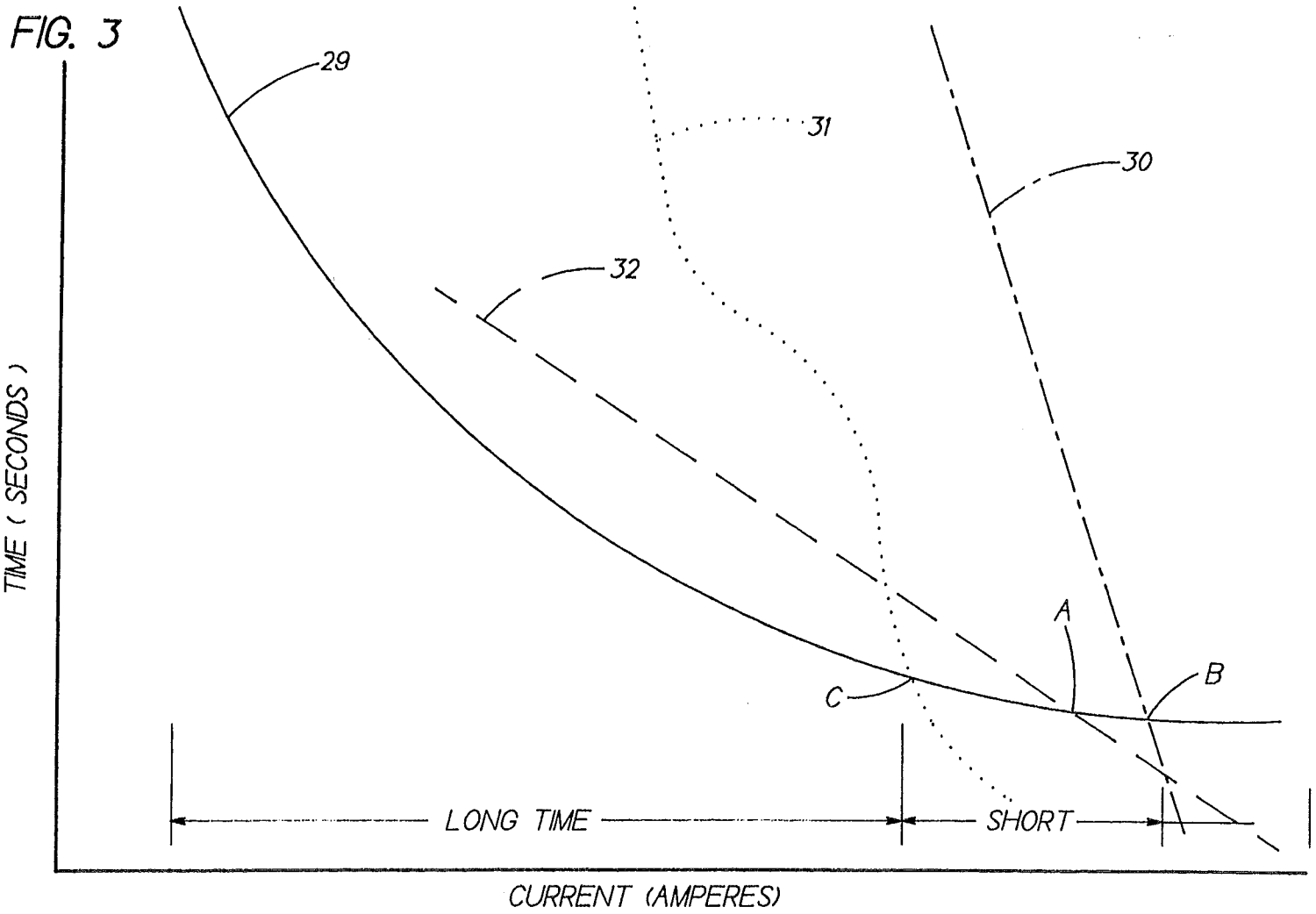
FIG. 3 is a graphic representation of the over-current protection coordination provided by the circuit breaker of FIG. 1 and FIG. 2.

The motor protective circuit breaker 10 is depicted in FIG. 2 prior to installing the trip actuator unit 17 within the trip actuator recess 17A formed within the circuit breaker cover 12. As described within the aforementioned U.S. Pat. No. 4,649,455, the actuator unit includes an electromagnet 18 which controls the latch 19 and responds to instructions from the circuit breaker trip unit to articulate the associated circuit breaker operating mechanism (not shown) to interrupt circuit current. One pair of conductors 27 electrically connects with the electronic trip unit while a separate pair of conductors 28 connects with a remote switch to operate the trip actuator unit from a remote location. The electronic circuit within the actuator unit for such remote trip function is described within U.S. Pat. No. 4,890,184. The fuse block 21 containing the motor-protective fuses 22 is inserted within the fuse compartment 21A in the circuit breaker cover 12. The circuit board 20 containing the circuit components 23 for integrating fuses with the electronic trip unit is installed within a separate recess 20A, as indicated. The accessory cover 13 is attached to the circuit breaker cover 12 by means of screws 24, thru-holes 25 and threaded openings 26. Access to the trip actuator unit 17 is made by means of the accessory door 16, while access to the fuse board 21 for replacement purposes is made by means of the accessory door 15. To allow coordination between the long time over-current protection provided by the thermal overload relay contained within the motor control equipment enclosure along with the circuit breaker, the short time over-current provided by the electronic trip unit and the short circuit protection provided by the fuses 22, the size of the fuses is selected to remain intact during the increased currents realized during motor reversal while rapidly becoming melted upon the occurrence of an actual short circuit fault within the motor control circuit or the motor itself. It has been determined that when the motor reversing transient current is less than or equal to 55% the average melting current for 10 milliseconds, the characteristics provided by the electronic trip unit provide good coordination as best seen by now referring to the ideal motor and associated wiring and equipment overload thermal damage profile, hereafter "thermal profile" 32 shown in FIG. 3.

The coordination provided by the invention complies with the Type 2 coordination, as described within I.E.C. standard 947-4-1, which requires that the motor control unit remain operational after the occurrence of a short circuit within the associated electric circuit. The thermal overload relay protection profile 29 extends across the long time, short time and short circuit current interruption intervals and intersects the thermal profile 32 at point A. The fuse protection profile 30 intersects the thermal profile 32 at point B whereas the electronic protection profile 31 intersects the thermal profile 32 at point C. Accordingly, long time over-current protection is provided by the electronic relay, short time overcurrent is provided by the electronic trip unit and short circuit protection is provided by the fuses as compared to the thermal protection profile.

Figure 4:
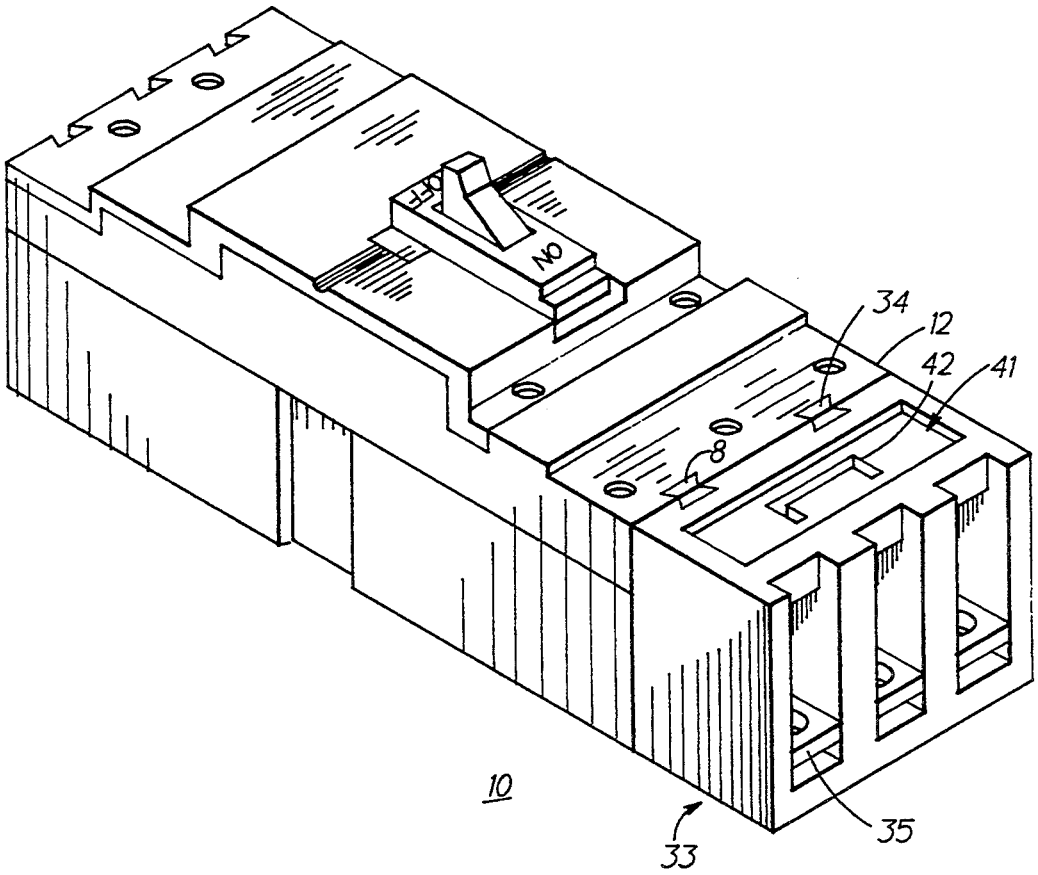
FIG. 4 is a top perspective view of the circuit breaker of FIG. 1 with a fuse module attached to one/end.

A motor protective circuit breaker 10 is depicted in FIG. 4 with the fuses contained within a fuse module 33 shown attached to the load end of the circuit breaker. The fuses are contained within a fuse holder 41 which is removed for replacement by means of the access handle 42. A pair of dovetail shaped projections 34 formed on one side of the module is received within corresponding dovetail slots 8 which are formed within the circuit breaker cover 12. Terminal straps 35 extending outside the module allow for connection with the associated electrical equipment.

Figure 5:
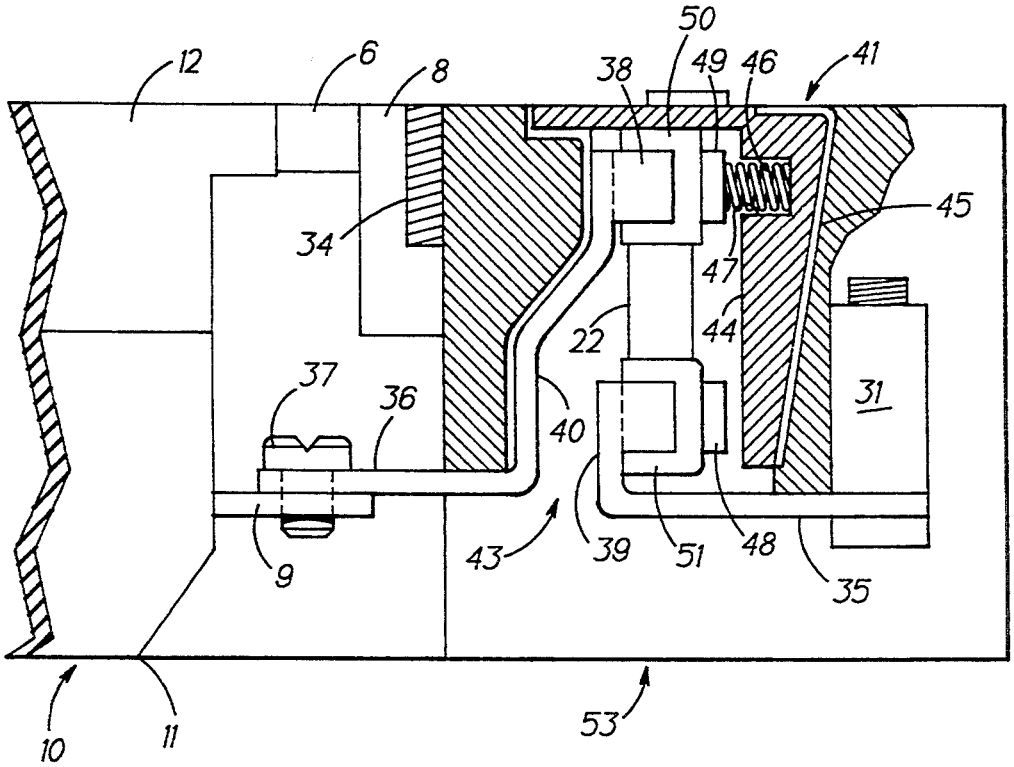
FIG. 5 is a side view in partial section of the fuse module of FIG. 4.

The motor protective circuit breaker 10 is shown in FIG. 5 to detail the connection between the dovetail projections 34 on the module 33 within the dovetail slots 8 within the circuit breaker cover 12. Electrical and mechanical connection is made by means of the attachment of the ends 36 of the fuse terminal straps 40 to the circuit breaker load terminal straps 9 on the circuit breaker case 11 by means of screws 37. Electrical access to the screws is made by means of the openings 6 in the circuit breaker cover. The fuse holder 41 includes a tapered sidewall 44 which fits within the tapered end wall 45 formed within the fuse holder recess 43. The other end of the terminal strap 40 is shaped to form one of the fuse clips 38. The other fuse clip 39 is formed on the end of the fuse terminal strap 35 opposite the fuse terminal lug 53. The contacts 50, 51 on the fuses 22 are press-fit within the clips for electrical connection with the circuit breaker. The contact post 48 extending from the bottom of the tapered sidewall 44 and the contact post 49, biased by means of the contact spring 46 within the spring recess 47 assure good electrical connection between the contacts and the clips at all times.

A motor protective circuit breaker has herein been described having a plurality of fuses connected in series to provide short circuit protection to the motor and associated equipment and wiring and a thermal overload relay to protect against long time overcurrent faults. The fuses are located within a recess formed in the circuit breaker cover or in a module attached to one end thereof.

We claim:

1. A motor-protective circuit breaker comprising:

a molded plastic case and cover;

operating means within said case for interrupting circuit current upon the occurrence of an overcurrent condition within a protected electric circuit;

an electronic trip unit within said cover determining occurrence of an overcurrent condition and instructing said operating means when said condition is exceeded; and a fuse in electric circuit with said electronic trip unit and with an electric motor, said fuse becoming operational to interrupt circuit current upon occurrence of a short circuit overcurrent condition within said protected circuit, said fuse being sized to resist melting at a circuit current value equal to or greater than fifty five percent reversal current through said motor.

2. The motor-protective circuit breaker of claim 1 wherein said fuse is mounted within an enclosure attached to said circuit breaker case.

3. The motor-protective circuit breaker of claim 1 further including an electric motor in circuit with said circuit breaker and said fuse.

4. The motor-protective circuit breaker of claim 1 wherein said circuit current remains uninterrupted upon occurrence of said reversal current.

* * * * *

UNITED STATES PATENT AND TRADEMARK OFFICE

CERTIFICATE OF CORRECTION

PATENT NO. : 5,426,406

DATED : Jun. 20, 1995

INVENTOR(S) : Robert A. Morris, Burlington; David D. MacDonald, Unionville, both of Conn.

It is certified that error appears in the above-indentified patent and that said Letters Patent is hereby corrected as shown below:

On the title Page: Item [63] should read--
Related U.S. Application Data
Continuation of Ser. No. 140,928, Oct. 25, 1993 abandoned. --

Signed and Sealed this

Tenth Day of October, 1995

Bruce Lehman

*Attest:*

BRUCE LEHMAN

*Attesting Officer*

*Commissioner of Patents and Trademarks*